US006196125B1

(12) United States Patent
Persson

(10) Patent No.: US 6,196,125 B1
(45) **Date of Patent: *Mar. 6, 2001**

(54) SEALING ARRANGEMENT IN HYDRAULIC PRESS

(75) Inventor: Lars Persson, Marblehead, MA (US)

(73) Assignee: EP Technology AB, Malmö (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,692

(22) PCT Filed: Dec. 9, 1997

(86) PCT No.: PCT/SE97/02049

§ 371 Date: Jun. 29, 1999

§ 102(e) Date: Jun. 29, 1999

(87) PCT Pub. No.: WO98/25757

PCT Pub. Date: Jun. 18, 1998

(30) Foreign Application Priority Data

Dec. 10, 1996 (SE) ..... 9604539

(51) Int. Cl.[7] ..... B30B 1/32

(52) U.S. Cl. ..... 100/269.18; 100/269.01; 100/269.2; 92/177; 92/255; 277/434

(58) Field of Search ..... 100/269.21, 269.18, 100/269.01; 92/177, 255; 277/435, 434, 449

(56) References Cited

U.S. PATENT DOCUMENTS

| | | | | |
|---|---|---|---|---|
| 576,616 | * | 2/1897 | Roseman | 92/177 |
| 2,793,089 | * | 5/1957 | Anderson | 277/434 |
| 4,069,747 | * | 1/1978 | Forry et al. | 92/255 |
| 5,323,698 | * | 6/1994 | Prevost | 100/269.01 |
| 5,601,017 | | 2/1997 | Schoen . | |

FOREIGN PATENT DOCUMENTS

| | | |
|---|---|---|
| 58-218396 | 12/1983 | (JP) . |
| 61-74800 | 4/1986 | (JP) . |

* cited by examiner

*Primary Examiner*—Peter Vo
*Assistant Examiner*—Louis Huynh
(74) *Attorney, Agent, or Firm*—Oblon, Spivak, McClelland, Maier & Neustadt, P.C.

(57) ABSTRACT

A hydraulic press including a cylinder barrel, a piston and a seal housing. The cylinder barrel has an inner peripheral surface. The piston has a pressure side surface and is inserted in the cylinder barrel to form a chamber between the pressure side surface of the piston and the inner peripheral surface of the cylinder barrel. The chamber is configured to contain a hydraulic fluid. The seal housing includes an outer peripheral surface and an inner space which has an inner peripheral wall and which is configured to contain the hydraulic fluid. The seal housing is provided on the pressure side surface of the piston such that the outer peripheral surface is in contact with the inner peripheral surface of the cylinder barrel and such that the hydraulic fluid in the inner space presses the seal housing against the inner peripheral surface.

13 Claims, 5 Drawing Sheets

SEALING ARRANGEMENT IN HYDRAULIC PRESS

FIELD OF INVENTION

The present invention relates to a hydraulic press, and more specifically a hydraulic press provided with a preferably rectangular hydraulic cylinder unit. The rectangular hydraulic cylinder is suitable for pressing rectangular objects. The hydraulic press according to the invention also comprises a flexible frame consisting of parallel, flat pillars. A frame of this kind is known from our co-pending Swedish Patent Application No. 9602349-4, filed on Jun. 14, 1996. The invention relates particularly to an advantageous scaling arrangement, solving the problem of leakage in rectangular hydraulic cylinders.

STATE OF THE ART

Rectangular cylinder units are known, as such, in various contexts, e.g. for presses and combustion engines.

It is not previously known, however, to utilise rectangular hydraulic cylinders in hydraulic presses comprising a frame constructed from pillar modules. The pillars support the hydraulic cylinder from two opposite sides.

SUMMARY OF THE INVENTION

The present invention thus provides a press comprising a hydraulic cylinder unit with a cylinder barrel and a piston. The unit has a cross-section shape adapted to the product to be pressed. According to the invention, the press comprises a frame having parallel, flat pillars, surrounding the hydraulic cylinder unit on two opposite sides.

A seal housing is arranged on the hydraulically pressurised side of the piston, in such a manner as to press the seal housing against the internal surface of the cylinder barrel, to provide adequate sealing.

The invention is specified in detail by the accompanying claims.

BRIEF DESCRIPTION OF THE DRAWINGS

The invention is described in detail below, with reference to the accompanying drawings, in which.

DETAILED DESCRIPTION OF A PREFERRED EMBODIMENT

Figure 1:
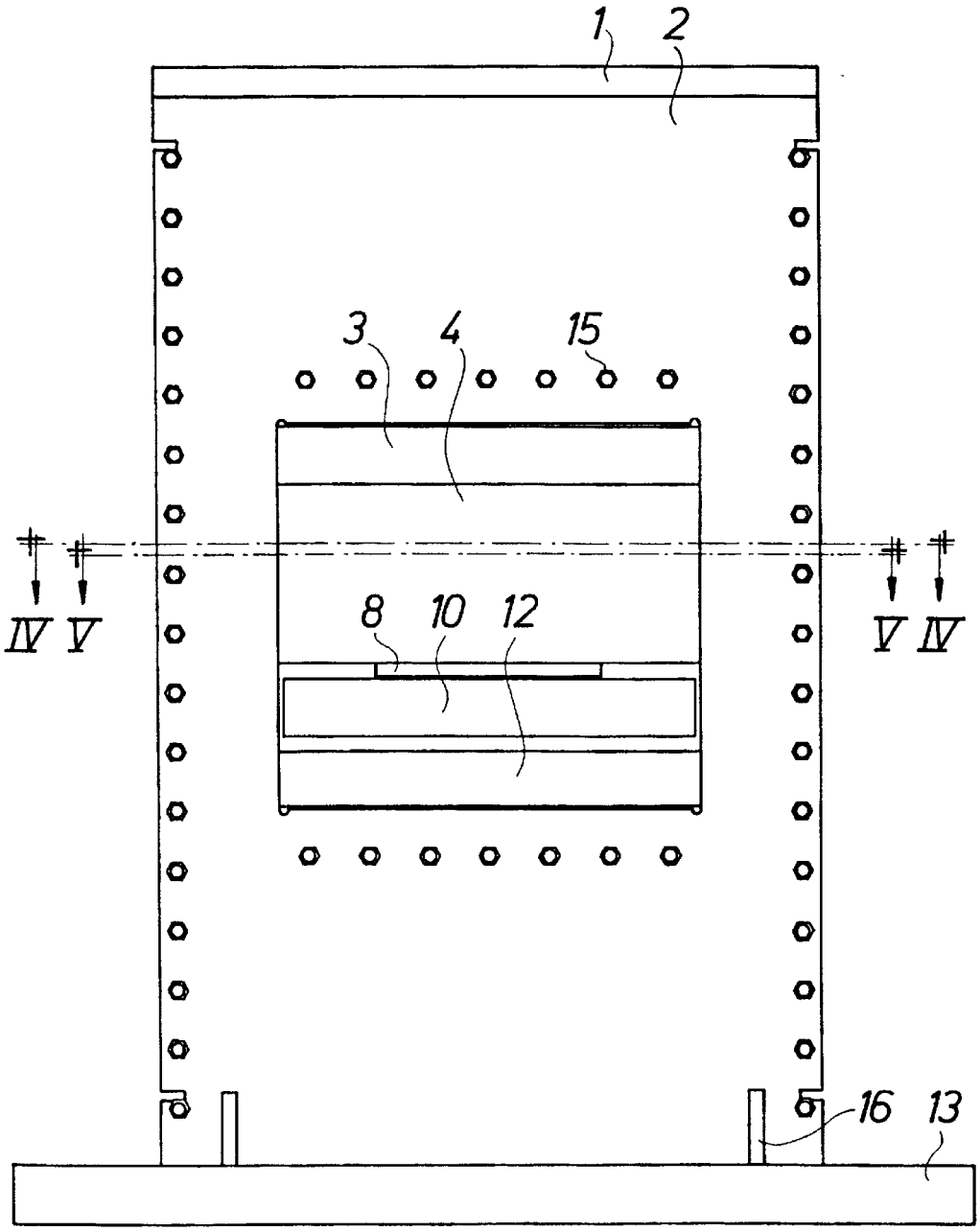
FIG. 1 is a front view of an embodiment of the hydraulic press according to the present invention.
Figure 2:
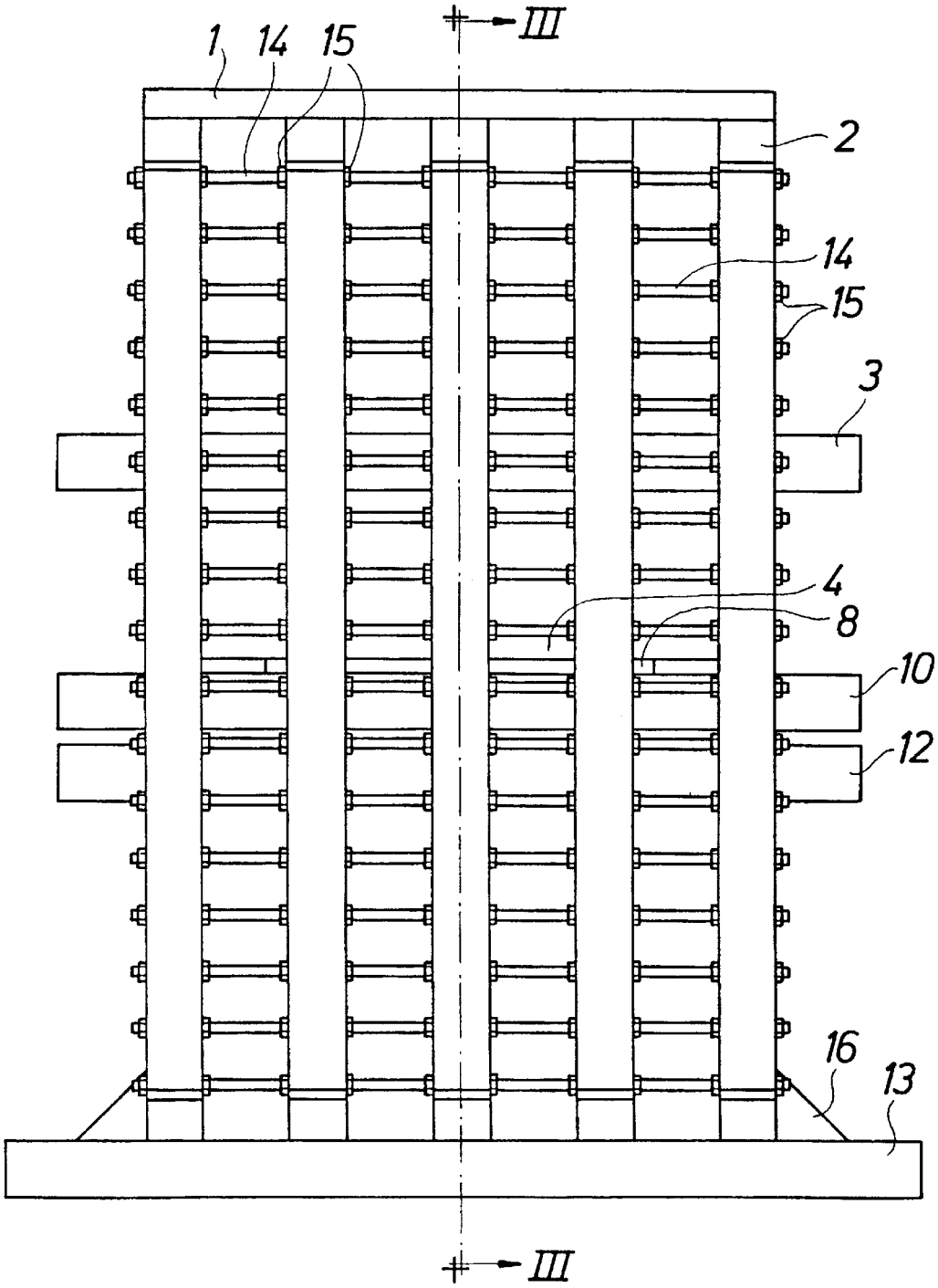
FIG. 2 is a side view of the hydraulic press of FIG. 1.

The invention thus relates to a hydraulic press having a hydraulic cylinder unit with a cylinder barrel and a piston, the cross-sections of which are adapted to the product to be pressed in the hydraulic press. The invention will be described with reference to a rectangular shape, as this shape is at present the most useful one. The advantage of having a rectangular cross-section of the hydraulic cylinder unit for a rectangular product, is that the pressing force will be evenly distributed across the surface to be pressed. Bending torque on the press tables outside the products are avoided.

With e.g. circular hydraulic cylinder units and rectangular products, thick press tables are required to distribute the pressing force evenly across the product. Other advantages are that an adapted pressure may be used, and that the dimensions and the weight of the hydraulic press may be generally reduced in a favourable way.

The hydraulic cylinder unit according to the invention is arranged in a frame as will be described in the following. A patent on the frame has been separately applied for in our Swedish Patent Application No. 9602349-4. This frame has many advantages regarding manufacture, transport and assembly, etc., as is described in more detail in said application.

With reference to the drawings, a frame suitable for a hydraulic press is illustrated, together with part of the machinery equipment for the hydraulic press. Pressing dies and other conventional equipment are not shown in the drawings, for increased clarity in illustrating the idea of the invention. The frame generally comprises vertical and parallel plates or pillars 2. In the embodiment shown, the number of pillars is five. In the pillars 2, a number of holes are provided. Through these holes run threaded rods 14. The number of vertical pillars 2 and the number of threaded rods 14 may of course be varied as necessary.

The pillars 2 are held at correct distances from each other by means of nuts 15, which are placed on both sides of each plate 2, and which are tightened to fix the pillars in position. The distance between the pillars can be easily adjusted by loosening the nuts and screwing them in one direction or the other to displace the pillar located between them. In this manner, the distance between the pillars 2 may be set completely arbitrarily.

In order to further stabilise the frame, and to fasten items of machinery, a horizontal top plate, here called roof 1, is preferably attached to the upper side of the frame. The roof 1 may conveniently be fastened by screws, as shown in the drawings.

The frame is also preferably equipped with a bottom plate or mounting 13, fastened by screws and angle irons 16.

The hydraulic press frame further comprises an upper press table 3 and a lower press table 12 for fixing the hydraulic press, the press table 3 being provided with entrance holes for the hydraulic and other connectors of the hydraulic press. The press tables are fastened to the different plates by their respective screws, see e.g. at 11.

Figure 3:
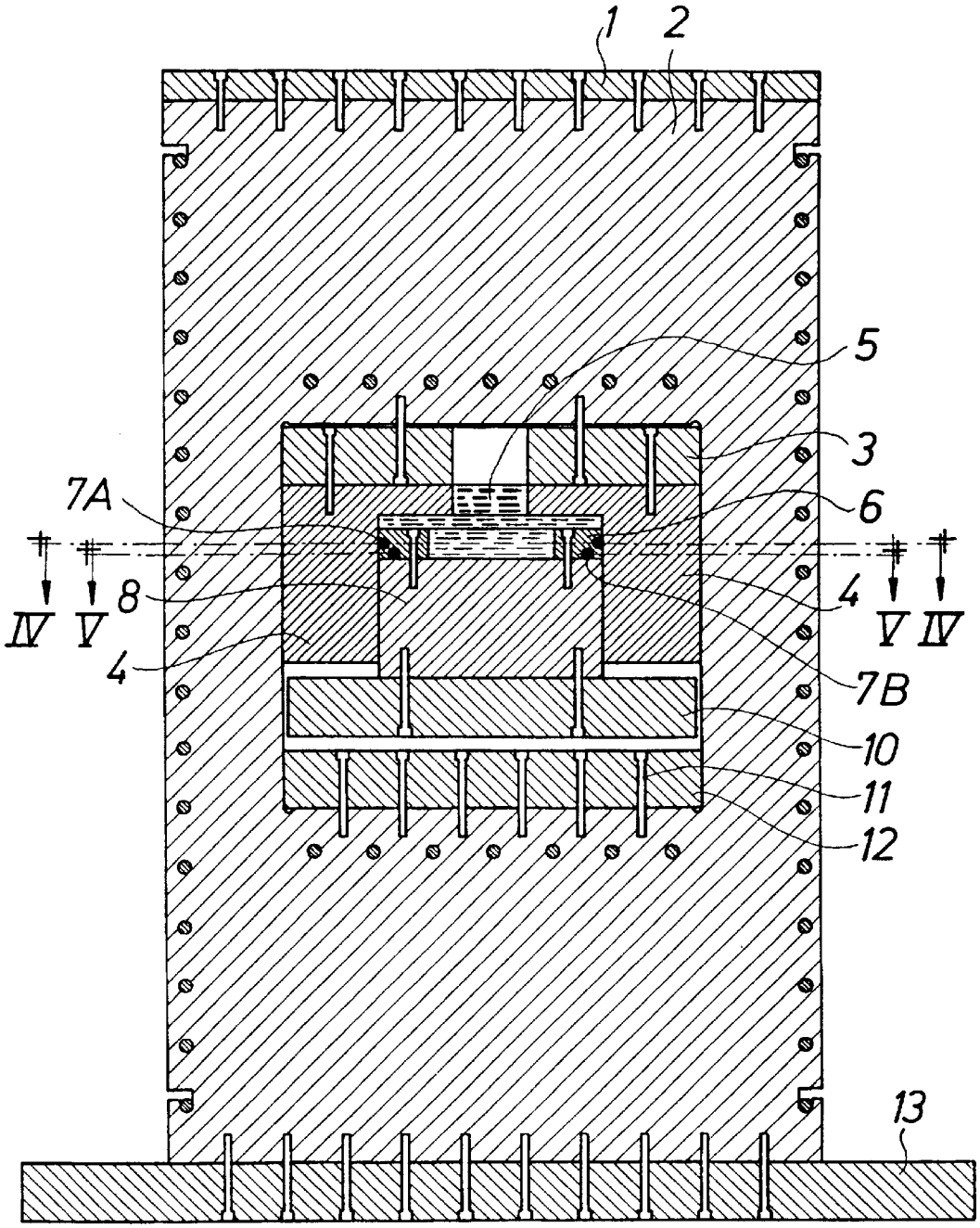
FIG. 3 is a section view according to the line III—III in FIG. 2.

Referring now particularly to FIG. 3, the design of the hydraulic cylinder unit is illustrated. The hydraulic cylinder unit comprises a cylinder barrel 4 having an approximately rectangular cross-section (see FIGS. 4 and 5). The cylinder barrel 4 is fastened to the upper press table 3 by means of screws. The barrel has a hydraulic pressure inlet 5 for hydraulic fluid. The hydraulic fluid acts upon the top side of a piston 8, having a corresponding cross-section. The piston 8 is attached to a moving press table 10. An object to be pressed is placed between the moving press table 10 and the lower press table 12.

Figure 4:
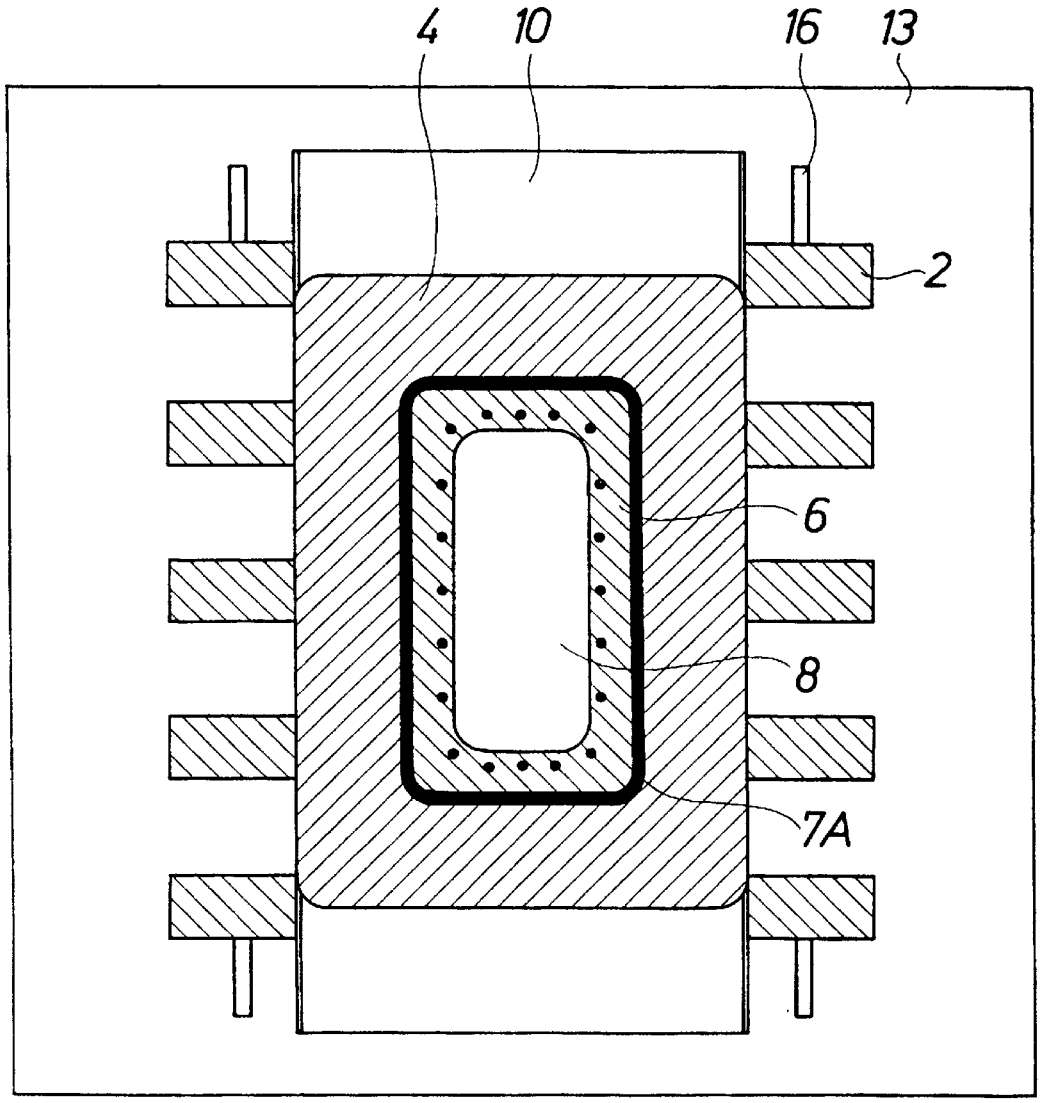
FIG. 4 is a section view according to the line IV—IV in FIG. 1.
Figure 5:
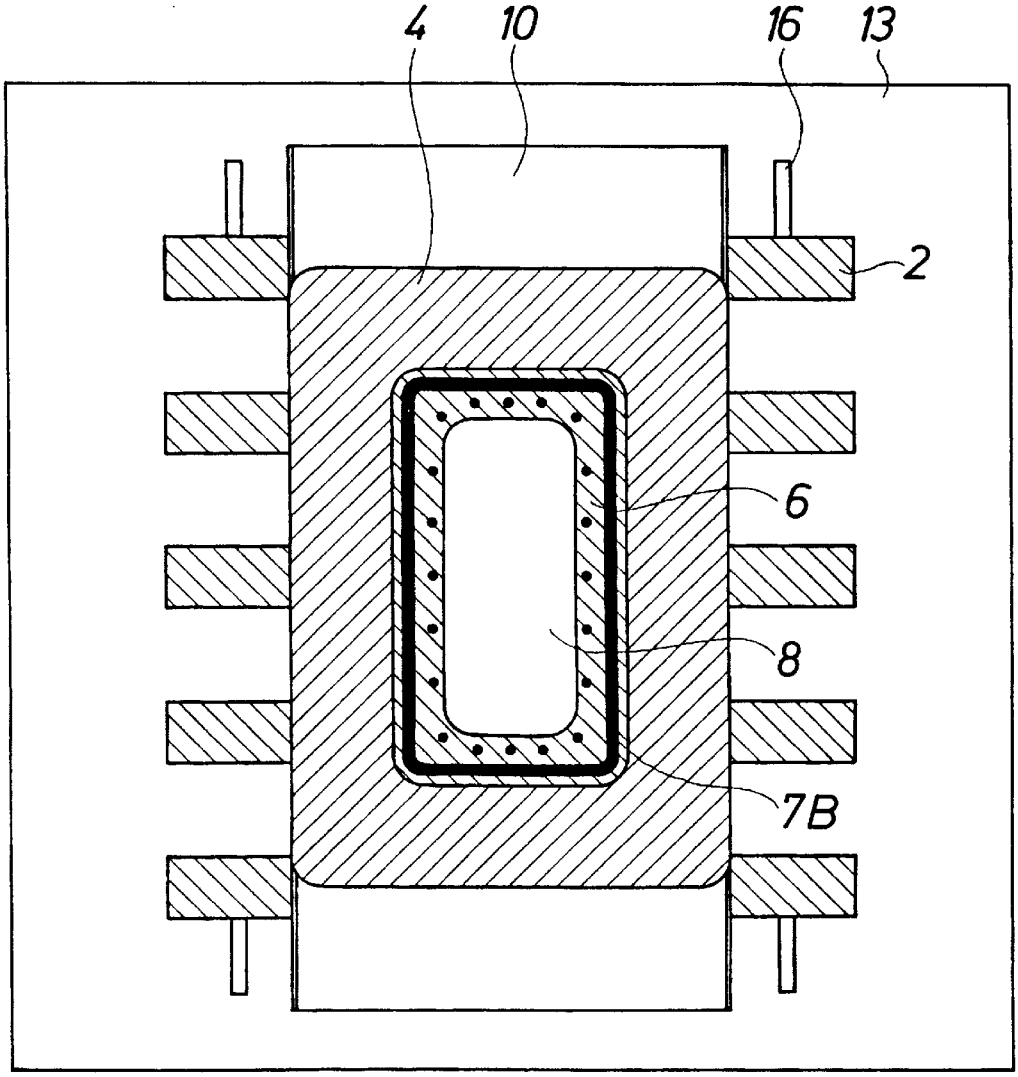
FIG. 5 is a section view according to the line V—V in FIG. 1.

When the hydraulic fluid is pressurised inside the barrel, the latter is subjected to a certain deflection, which is somewhat waved, due to the barrel only being supported at the pillars 2, see in particular the section views of FIGS. 4 and 5. The piston 8, however, is only subjected to an axial pressure and does not deflect sideways. If the piston 8 had been equipped with conventional seals between the piston 8 and the cylinder barrel 4, a wave-shaped clearance would have been created here, which had been difficult to seal off.

The present invention, however, includes a new sealing arrangement allowing an efficient seal between piston and barrel. A seal housing 6 is provided on the pressure side of the piston 8. As is best seen in FIGS. 4 and 5, the seal housing is shaped like a rectangular ring. Consequently, the hydraulic pressure acts on the inside of the seal housing, pressing it against the inner surface of the barrel 4. The seal housing 6 is made of a relatively flexible or soft material, so as to be able to adapt to the deflection of the barrel. A preferred material is bronze, but other materials are also conceivable, e.g. plastics.

The seal housing is fixed to the piston by fastening means extending, with a clearance (not visible), in holes in the seal housing. The clearances are large enough for the seal housing to be able to follow the deflection of the cylinder barrel 4 without causing any stressing of the piston 8.

In order to further improve the seal, hydraulic seals 7A, 7B are provided in grooves in the seal housing 6. Preferably, there is a lateral seal 7A between the seal housing 6 and the barrel 4, as can be seen in the section view of FIG. 4, and an axial sealing device 7B between the seal housing 6 and the piston 8, as can be seen in the section view of FIG. 5. The sealing devices are compressed to so called zero play for an efficient sealing function.

The present invention thus provides a hydraulic press having the above described advantages.

As has been mentioned above, and as is evident for a person skilled in the art, many modifications and variations are conceivable, without deviating from the scope of the invention as defined by the following claims.

What is claimed is:

1. A hydraulic press comprising a hydraulic cylinder unit, having a cylinder barrel, a piston, and a seal housing, and being arranged to contain a hydraulic fluid in a volume enclosed by said cylinder barrel and said piston, defining a pressure side on one side of said piston, wherein said seal housing is mounted on the pressure side of the piston in contact with an inner surface of said cylinder barrel and is movable relative to the piston, and provided with an inner space having an internal wall, said inner space being arranged to contain a part of the hydraulic fluid, in such a manner that the hydraulic fluid acts on said internal wall, whereby the hydraulic pressure forces the seal housing against the inner surface of the cylinder barrel to follow the inner surface of the cylinder barrel.

2. A hydraulic press according to claim 1, wherein the seal housing is attached to the piston in a radially displaceable manner.

3. A hydraulic press according to claim 2, wherein the seal housing is attached to the piston by means of fastening means extending, with a clearance, through holes in the seal housing.

4. A hydraulic press according to any one of claims 1, 2, or 3, wherein the seal housing is made of a flexible material.

5. A hydraulic press according to claim 4, wherein the seal housing is made of bronze.

6. A hydraulic press according to claim 4, wherein the seal housing is made of plastics.

7. A hydraulic press according to claim 1, wherein at least one sealing device is provided in a groove in the seal housing.

8. A hydraulic press according to claim 7, wherein one of said at least one scaling device is arranged in a lateral groove and in contact with the inner surface of the cylinder barrel, and wherein another of said at least one sealing device is arranged in an axial groove and in contact with the surface of the piston.

9. A hydraulic press according to claim 7, wherein the sealing device is compressed to zero clearance.

10. A hydraulic press according to claim 1, wherein the cross-section shape of the cylinder unit is rectangular.

11. A hydraulic press comprising:

a cylinder barrel having an inner peripheral surface;

a piston having a pressure side surface and inserted in the cylinder barrel to form a chamber between the pressure side surface of the piston and the inner peripheral surface of the cylinder barrel, the chamber being configured to contain a hydraulic fluid; and a seal housing including an outer peripheral surface and an inner space which has an inner peripheral wall and which is configured to contain part of the hydraulic fluid, the seal housing being provided on and being movable relative to the pressure side surface of the piston such that the outer peripheral surface of the seal housing is in contact with the inner peripheral surface of the cylinder barrel and such that the hydraulic fluid in the inner space presses the seal housing against the inner peripheral surface acting on the inner wall of the seal housing to follow the inner peripheral surface of the cylinder barrel.

12. A hydraulic press comprising a hydraulic cylinder unit, having a cylinder barrel, a piston, and a seal housing, and being arranged to contain a hydraulic fluid in a volume enclosed by said cylinder barrel and said piston, defining a pressure side on one side of said piston, wherein said seal housing is made of a flexible material and is mounted on the pressure side of the piston in contact with an inner surface of said cylinder barrel, and provided with an inner space having an internal wall, said inner space being arranged to contain a part of the hydraulic fluid, in such a manner that the hydraulic fluid acts on said internal wall, whereby the hydraulic pressure forces the seal housing against the inner surface of the cylinder barrel to follow the inner surface of the cylinder barrel.

13. A hydraulic press comprising:

a cylinder barrel having an inner peripheral surface;

a piston having a pressure side surface and inserted in the cylinder barrel to form a chamber between the pressure side surface of the piston and the inner peripheral surface of the cylinder barrel, the chamber being configured to contain a hydraulic fluid; and a seal housing made of a flexible material and including an outer peripheral surface and an inner space which has an inner peripheral wall and which is configured to contain the hydraulic fluid, the seal housing being provided on the pressure side surface of the piston such that the outer peripheral surface of the seal housing is in contact with the inner peripheral surface of the cylinder barrel and such that the hydraulic fluid in the inner space presses the seal housing against the inner peripheral surface acting on the inner wall of the seal housing to follow the inner peripheral surface of the cylinder barrel.

* * * * *